US008631966B2

(12) United States Patent
Pirner

(10) Patent No.: US 8,631,966 B2
(45) Date of Patent: Jan. 21, 2014

(54) SPECIMEN CONTAINER WITH CAP HAVING A SNAP-FIT PARTIALLY OPEN POSITION

(75) Inventor: Thomas Pirner, Minden (CA)

(73) Assignee: Starplex Scientific Inc., Etobicoke (CA)

( * ) Notice: Subject to any disclaimer, the term of this patent is extended or adjusted under 35 U.S.C. 154(b) by 169 days.

(21) Appl. No.: 13/021,567

(22) Filed: Feb. 4, 2011

(65) Prior Publication Data

US 2012/0043328 A1 Feb. 23, 2012

Related U.S. Application Data

(60) Provisional application No. 61/376,011, filed on Aug. 23, 2010, provisional application No. 61/376,518, filed on Aug. 24, 2010.

(51) Int. Cl.

| | |
|---|---|
| ***B65D 43/14*** | (2006.01) |
| ***B65D 45/16*** | (2006.01) |
| ***B65D 41/00*** | (2006.01) |

(52) U.S. Cl.

USPC ..... 220/834; 220/324; 215/235; 215/354

(58) Field of Classification Search

USPC ..... 215/235, 237, 306, 354; 220/839, 220/831–835, 324, 802, 789–791, 4.23, 220/375, 360

See application file for complete search history.

(56) References Cited

U.S. PATENT DOCUMENTS

| | | | |
|---|---|---|---|
| RE29,779 | E | 9/1978 | Morris |
| 4,171,057 | A | 10/1979 | Gach |
| 4,203,524 | A | 5/1980 | Wieland |
| 4,262,802 | A | 4/1981 | Laauwe |
| 4,346,809 | A | 8/1982 | Kusz |
| 4,406,376 | A | 9/1983 | Berghahn |
| 4,449,639 | A | 5/1984 | Davis |
| 4,457,437 | A | 7/1984 | Heath, Jr. |
| 4,482,068 | A | 11/1984 | Agbay et al. |
| 4,526,281 | A | 7/1985 | Herr |
| 4,567,992 | A | 2/1986 | Davis |

(Continued)

FOREIGN PATENT DOCUMENTS

| | | |
|---|---|---|
| WO | 01/60518 A1 | 8/2001 |

OTHER PUBLICATIONS

European Search Report—European application No. EP 11 17 8494.

*Primary Examiner* — Steven A. Reynolds
*Assistant Examiner* — Javier A Pagan
(74) *Attorney, Agent, or Firm* — Gifford, Krass, Spinkle, Anderson & Citkowski, P.C.

(57) ABSTRACT

The specimen container comprises a cap, a body and a connector. The cap has an inner surface defining a hollow. The body includes a vial having a rim and an opening bounded by the rim. The connector couples the cap and body in a manner which permits cap movement between a fully-seated position on the vial, to form a sealed specimen container; and a position apart from the opening, to permit ingress to the vial. The connector can be adapted such that, in use, when the cap is disposed at the position apart from the opening, and in the absence of external forces, the connector holds the cap at the position apart from the opening. Snap-fit intermediate positions of the cap can be provided between the position apart from the opening and the fully-seated position and the cap can be adapted to reduce evaporative losses when intermediately positioned.

15 Claims, 8 Drawing Sheets

(56) References Cited

U.S. PATENT DOCUMENTS

| | | | | |
|---|---|---|---|---|
| 4,579,238 | A | | 4/1986 | Herr |
| 4,613,063 | A | | 9/1986 | Wright |
| 4,669,620 | A | | 6/1987 | Coifman |
| 4,687,112 | A | | 8/1987 | Swartzbaugh |
| 4,723,685 | A | | 2/1988 | Fillmore et al. |
| 4,729,487 | A | | 3/1988 | Wright |
| 4,732,288 | A | | 3/1988 | Morris, Sr. |
| 4,739,890 | A | | 4/1988 | Cooke |
| 4,752,013 | A | | 6/1988 | Miller et al. |
| 4,752,014 | A | | 6/1988 | House et al. |
| 4,760,763 | A | | 8/1988 | Trick et al. |
| 4,782,963 | A | | 11/1988 | Hunter |
| 4,832,218 | A | | 5/1989 | Gibilisco |
| 4,838,441 | A | | 6/1989 | Chernack |
| 4,865,209 | A | | 9/1989 | Bush |
| 4,895,282 | A | | 1/1990 | Robinson |
| 4,909,404 | A | | 3/1990 | Rozenberg |
| 4,940,167 | A | | 7/1990 | Fillmore et al. |
| 4,948,002 | A | | 8/1990 | Thornock et al. |
| 4,957,210 | A | | 9/1990 | Kusz |
| 4,979,648 | A | | 12/1990 | Montgomery et al. |
| 4,989,739 | A | | 2/1991 | Falcone et al. |
| 4,997,096 | A | | 3/1991 | Kusz |
| 4,998,632 | A | | 3/1991 | Morris, Sr. |
| 5,005,718 | A | | 4/1991 | Buono |
| 5,020,681 | A | | 6/1991 | Kusz |
| 5,027,954 | A | | 7/1991 | Hickerson |
| 5,031,784 | A | | 7/1991 | Wright |
| 5,040,691 | A | | 8/1991 | Hayes et al. |
| 5,058,754 | A | | 10/1991 | Hickerson |
| 5,065,876 | A | | 11/1991 | Joyce |
| 5,078,288 | A | | 1/1992 | Fuchs |
| 5,082,130 | A | | 1/1992 | Weinstein |
| 5,092,477 | A | | 3/1992 | Johnson, Jr. et al. |
| 5,114,029 | A | | 5/1992 | Gibilisco |
| 5,115,928 | A | | 5/1992 | Drummond, Jr. |
| 5,115,929 | A | | 5/1992 | Buono |
| 5,133,470 | A | | 7/1992 | Abrams et al. |
| 5,137,260 | A | | 8/1992 | Pehr |
| 5,147,052 | A | | 9/1992 | Minette |
| 5,270,011 | A | * | 12/1993 | Altherr ..... 422/547 |
| 5,398,837 | A | * | 3/1995 | Degrassi ..... 220/835 |
| 5,474,177 | A | | 12/1995 | Abrams et al. |
| 5,723,085 | A | | 3/1998 | Abrams et al. |
| 5,863,791 | A | | 1/1999 | Baldszun et al. |
| 5,979,804 | A | | 11/1999 | Abrams et al. |
| D421,216 | S | | 2/2000 | Abrams et al. |
| 6,303,064 | B1 | | 10/2001 | Abrams et al. |
| RE37,676 | E | | 4/2002 | Abrams et al. |
| 6,531,096 | B1 | | 3/2003 | Deveney et al. |
| 7,472,797 | B2 | | 1/2009 | Ostrowski |
| 7,854,895 | B2 | * | 12/2010 | Gallagher et al. ..... 422/553 |
| 2006/0043100 | A1 | * | 3/2006 | Johnson et al. ..... 220/839 |
| 2007/0031297 | A1 | | 2/2007 | Roussel |
| 2007/0128080 | A1 | | 6/2007 | Lohn |
| 2007/0208274 | A1 | | 9/2007 | Ostrowski et al. |
| 2008/0035602 | A1 | | 2/2008 | Gooden et al. |
| 2008/0035658 | A1 | | 2/2008 | Caulfield et al. |
| 2009/0202393 | A1 | | 8/2009 | Gallagher et al. |
| 2009/0209044 | A1 | | 8/2009 | Gallagher et al. |

* cited by examiner

SPECIMEN CONTAINER WITH CAP HAVING A SNAP-FIT PARTIALLY OPEN POSITION

CROSS-REFERENCE TO RELATED APPLICATIONS

This application claims priority of U.S. Provisional Patent Applications 61/376,011 filed Aug. 23, 2010, and 61/376,518 filed Aug. 24, 2010, which are incorporated herein by reference.

FIELD OF THE INVENTION

The present invention relates to the field of specimen collection.

BACKGROUND OF THE INVENTION

It is well known to use a vial and a cap for the collection of specimens. It is also well-known for the cap and the vial to be injection-molded as a unit, connected by a flexible strap.

SUMMARY OF THE INVENTION

Apparatus forms one aspect of the invention. This apparatus comprises a cap, a body and a connector. The cap has an inner surface defining a hollow. The body includes a vial having a rim and an opening bounded by the rim. The connector couples the cap to the body in a manner which permits movement of the cap between a fully-seated position on the vial and a position apart from the opening. In the fully-seated position, the cap and body form a sealed specimen container. At the position apart from the opening, the cap permits ingress to the vial. The connector is adapted such that, in use, when the cap is disposed at the position apart from the opening, and in the absence of external forces, the connector holds the cap at the position apart from the opening.

According to another aspect of the invention, the cap can have an initial position removed from the opening.

According to another aspect of the invention, movement of the cap from the initial position to the fully-seated position can result in inelastic deformation of the connector, said inelastic deformation of the connector adapting said connector such that, as aforesaid, in use, when the cap is disposed at the position apart from the opening, and in the absence of external forces, the connector holds the cap at the position apart from the opening.

According to another aspect of the invention, during movement between the fully-seated position and the initial position, and during movement between the fully-seated position and the position apart from the opening, the cap and rim move relative to one another in the manner of a porthole window.

According to another aspect of the invention, the vial can be tubular and can have a central longitudinal axis and, in the position apart from the opening, the cap extends substantially longitudinally from a position adjacent the rim of the vial.

According to another aspect of the invention, during movement from the fully-seated position to the position apart from the opening, the cap can rotate about a pivot axis an angle that lies in the range between about 90° and about 120°.

According to another aspect of the invention, the position apart from the opening can be intermediate the fully-seated position and the initial position and the connector can be adapted such that, in use, when the cap is removed from the rim, and in the absence of external forces, the connector urges the cap for movement to the position apart from the opening.

According to another aspect of the invention, the cap and the vial can have inter-engageable detents which provide for snap-fit intermediate positions of the cap between the position apart from the opening and the fully-seated position.

According to another aspect of the invention, the inter-engageable detents can comprise: at least one detent positioned on the vial; and at least one detent positioned on the inner surface of the cap and protruding into the hollow.

According to another aspect of the invention, the at least one detent positioned on the vial can comprise a plurality of detents.

According to another aspect of the invention, the body can have a locking hook projecting from the vial adjacent the rim and the apparatus can further comprise a locking tab having a flexible portion joining the locking tab to the cap for movement of the locking tab between an unlocking position and a locking position, the locking tab and the locking hook being adapted such that, with the cap in the fully-seated position, movement of the locking tab from the unlocking position to the locking position causes the locking tab to engage the locking hook to restrain the cap against movement from the fully-seated position.

According to another aspect of the invention, the locking hook and the connector can be disposed on opposite sides of the vial.

According to another aspect of the invention, the detents positioned on the vial can be disposed beneath the rim.

According to another aspect of the invention, the vial can have a circumferential flange disposed below the rim and which abuts the cap when the cap is in the fully-seated position.

According to another aspect of the invention, the detents positioned on the vial can be disposed between the rim and the circumferential flange.

According to another aspect of the invention, a pair of arcuate flanges can be disposed on opposite sides of the vial, beneath the circumferential flange.

According to another aspect of the invention: the apparatus can further comprise an annular ridge projecting from the cap into the hollow to define an annular groove at the base of the hollow; the rim can be an enlarged rim; and, when the cap is in the fully-seated position, the rim is disposed in the annular groove in snap-fit relation, with the annular ridge disposed radially inwardly of the lip and the cap disposed radially outwardly of the lip.

Forming another aspect of the invention is apparatus comprising a cap, a body, a connector and means. The cap has an inner surface defining a hollow. The body includes a vial having a rim and an opening bounded by the rim. The connector couples the cap to the body in a manner which permits movement of the cap between a fully-seated position on the vial, to form a sealed specimen container and a position apart from the opening, to permit ingress to the vial. The means provides for snap-fit intermediate positions of the cap between the position apart from the opening and the fully-seated position.

According to another aspect, the means can comprise inter-engageable detents on the cap and vial.

Forming yet another aspect of the invention is apparatus comprising a cap, a body, a connector and an annular ridge. The cap has an inner surface defining a hollow. The body includes a vial having a rim and an opening bounded by the rim. The connector couples the cap to the body in a manner which permits movement of the cap between a fully-seated position on the vial, to form a sealed specimen container; and a position apart from the opening, to permit ingress to the vial. The annular ridge projects from the cap into the hollow to define an annular groove at the base of the hollow and terminates in a circular apex. When the cap is in the fully-seated position and the vial is seated on a horizontal surface: the rim is disposed in the annular groove in snap-fit relation, with the annular ridge disposed radially inwardly of the rim and the cap disposed radially outwardly of the rim; and the circular apex slopes downwardly as it extends towards the connector.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter being briefly described hereinafter.

DETAILED DESCRIPTION

Figure 1:
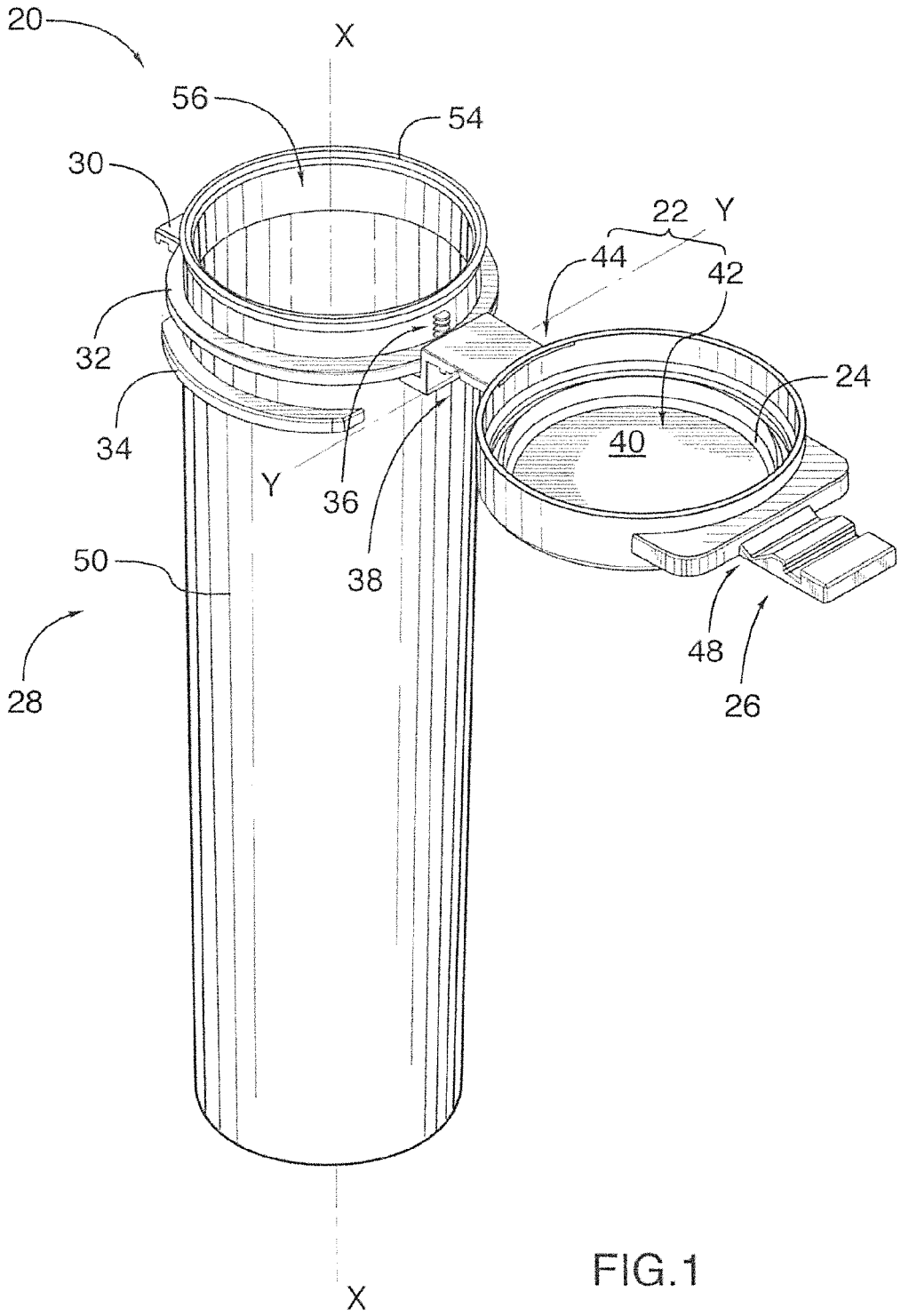
FIG. 1 is a perspective view of a specimen container according to an exemplary embodiment of the invention, with the cap in the initial position and the locking tab in the unlocking position.

A specimen container 20 according to an exemplary embodiment of the invention is shown in FIG. 1 through FIG. 3A and will be seen to comprise a body 28, a cap 22, an annular ridge 24, a locking tab 26, a locking hook 30, a plurality of detents 36, a circumferential flange 32, a pair of arcuate flanges 34, and a connector 38, all integrally injection-molded as a single unitary plastic assembly from homopolymer polypropylene.

The body 28 includes a tubular vial 50. The vial 50 is frustoconical, has an enlarged rim 54, an opening 56 bounded by the rim 54 and a central longitudinal axis X-X.

Figure 2:
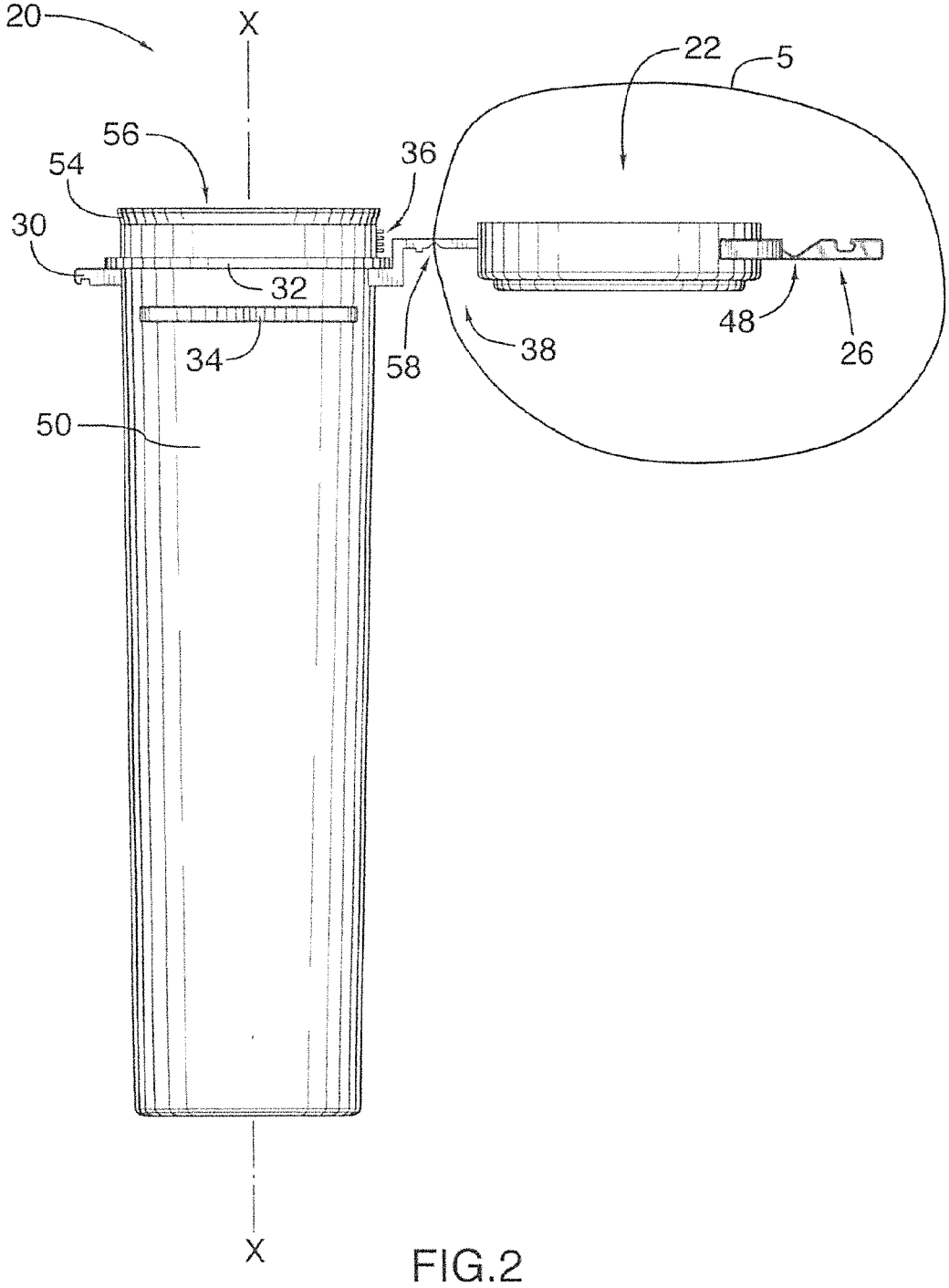
FIG. 2 is a side view of the structure of FIG. 1.
Figure 3:
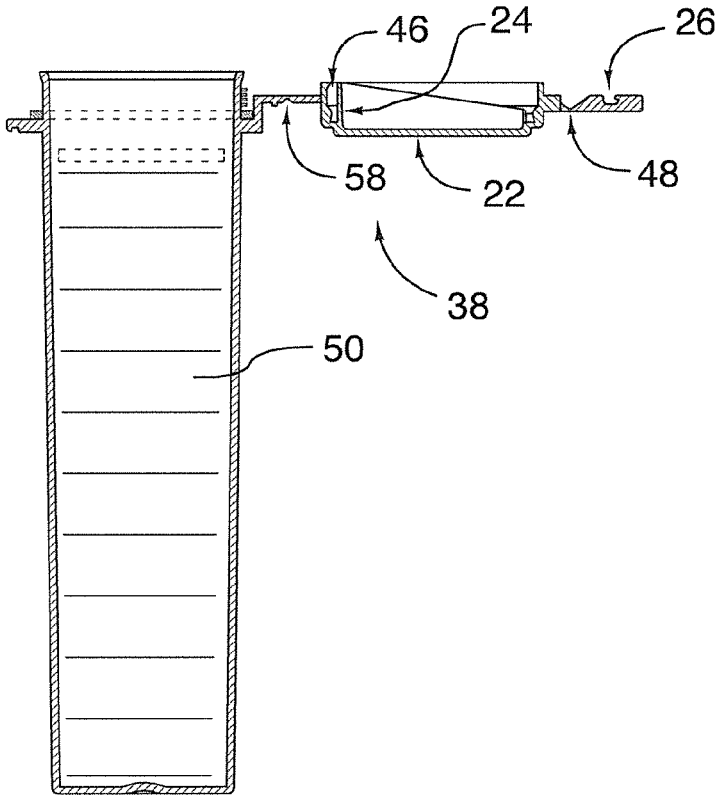
FIG. 3 is a cross-sectional view of the structure of FIG. 2.

The cap 22 has an inner surface 40 defining a hollow 42 and a detent 44 which is positioned on the inner surface 40 and protrudes into the hollow 42 and is shown in FIGS. 1-3 at an initial position (i.e. as molded) removed from the opening 56.

The annular ridge 24 projects from the cap 22 into the hollow 42 to define an annular groove 46 at the base of the hollow 42 and defines a circular apex 43.

The locking tab 26, shown in FIGS. 1-3A at an unlocking position, is joined to the cap 22, will be understood to have a flexible portion 48 and will be seen to be hook-like in structure.

The locking hook 30 projects from the vial 50 adjacent the rim 54.

The detents 36 are positioned on the outer surface of the vial 50, adjacent the rim 54.

The circumferential flange 32 is disposed below the rim 54 and the detents 36 of the vial 50.

The arcuate flanges 34 are disposed on opposite sides of the vial 50, beneath circumferential flange 32.

The connector 38 has a waisted portion 58, couples the cap 22 to the body 28 and is positioned such that the detents 36 positioned on the vial 50 are disposed between the rim 54 and the circumferential flange 32 and such that the locking hook 30 and the connector 38 are disposed on opposite sides of the vial 50.

Figure 4:
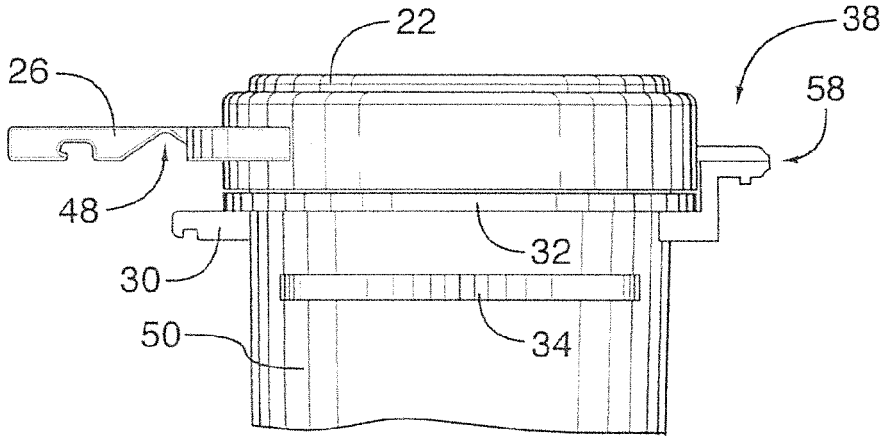
FIG. 4 is an enlarged view of a portion of FIG. 2, with the cap in a fully-seated position.

The waisted portion 58 is relatively flexible in relation to the remainder of the connector 38, so as to define a pivot axis Y-Y, permitting movement of the cap 22 relative to the rim 54 in the manner of a porthole window from:

the initial position shown in FIGS. 1-3A, wherein the cap 22 is apart from the opening 56;

to the fully-seated position shown in FIG. 4.

In the fully-seated position:

the apparatus 20 defines a sealed specimen container;

the rim 54 is disposed in the annular groove 46 in snap-fit relation, with the annular ridge 24 disposed radially inwardly of rim 54 and the cap 22 disposed radially outwardly of rim 54;

the circumferential flange 32 abuts the cap 22; and when the vial is seated on a horizontal surface, the circular apex slopes downwardly as it extends towards the connector 38.

Figure 3A:
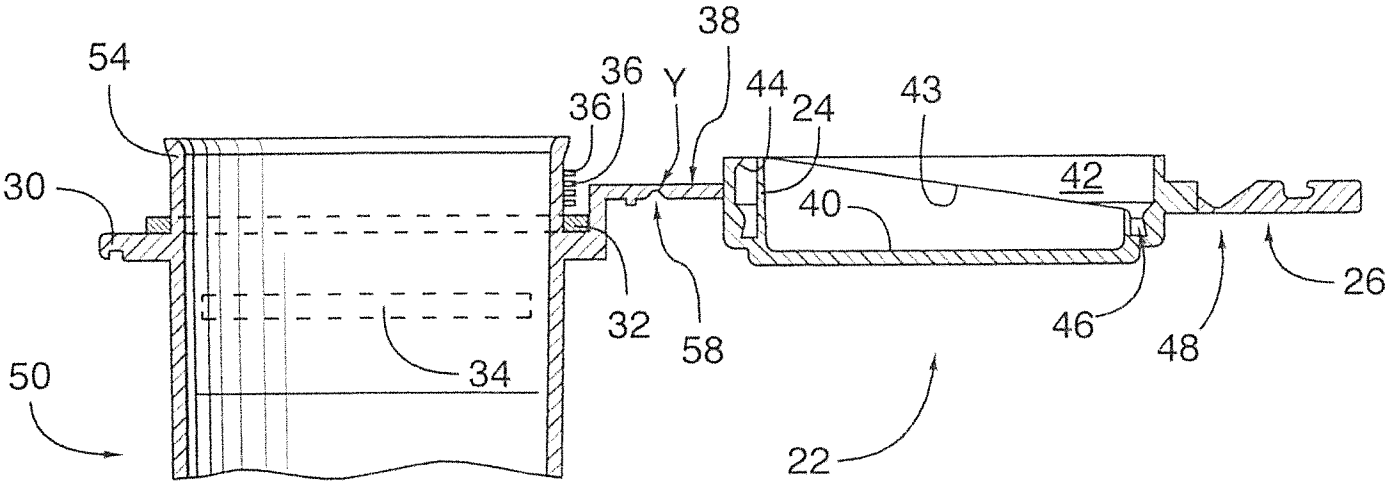
FIG. 3A is an enlarged view of a portion of FIG. 3.
Figure 5:
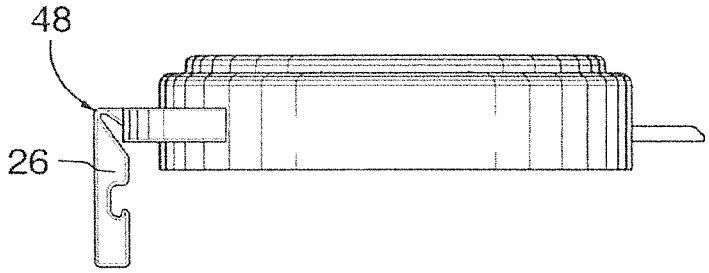
FIG. 5 is a view of the structure in encircled area 5 of FIG. 2, but with the locking tab in the locking position.

Returning now to the flexible portion 48 of the locking tab 26, same permits manual manipulation of the locking tab 26 between the unlocking position shown in FIG. 3A and a locking position shown in FIG. 5.

Figure 6:
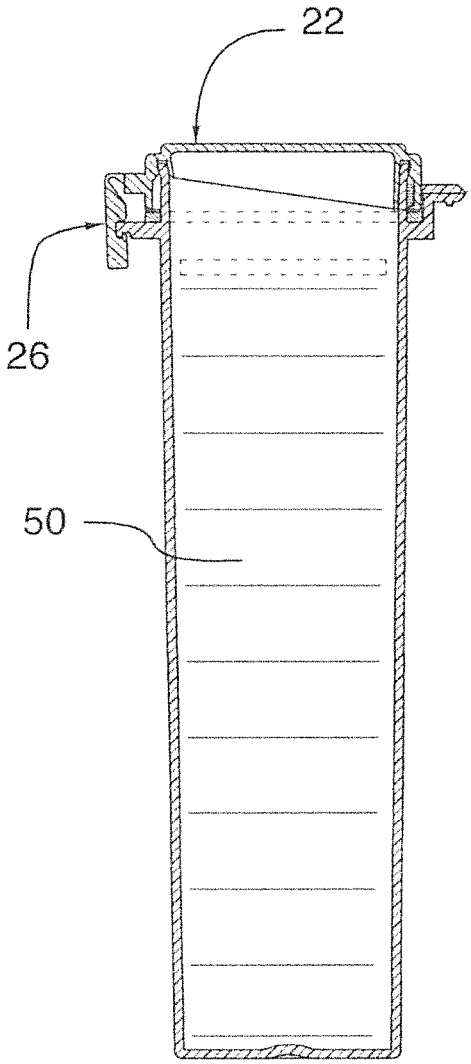
FIG. 6 is a view similar to FIG. 2, but with the cap in the fully-seated position and the locking tab in the locking position.

The locking tab 26 and the locking hook 30 are adapted such that, with the cap 22 in the fully-seated position, as shown in FIG. 4, movement of the locking tab 26 from the unlocking position to the locking position causes the locking tab 26 to engage the locking hook 30, as shown in FIG. 6, to restrain cap 22 against movement from the fully-seated position.

Figure 7:
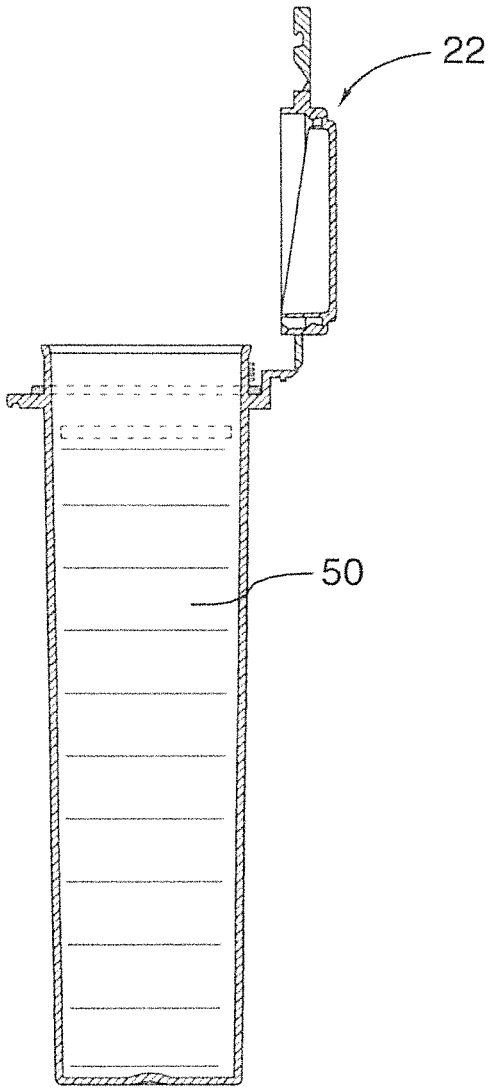
FIG. 7 is a view similar to FIG. 3, but with the cap in the position apart from the opening.

Returning now to the waisted portion 58 of the connector 38, same is adapted such that movement from the initial position to the fully-seated position results in inelastic deformation of the connector 38, said inelastic deformation of the connector 38 adapting said connector 38 to bias the cap 22 for movement to a position apart from the opening 56, as shown in FIG. 7, intermediate the fully-seated position and the initial position. In the exemplary embodiment illustrated, movement from the initial position to the position apart from the opening 56 is associated with a 90° rotation around pivot axis Y-Y defined by the connector 38.

In the position apart from the opening 56, the cap 22 extends substantially longitudinally from a position adjacent the rim 54 of the vial 50. Without limitation, it will be understood this bias provides, when the cap 22 is disposed at the position shown in FIG. 7, and in the absence of external forces, for the connector 38 to hold the cap 22 at the position apart from the opening 56.

Figure 10:
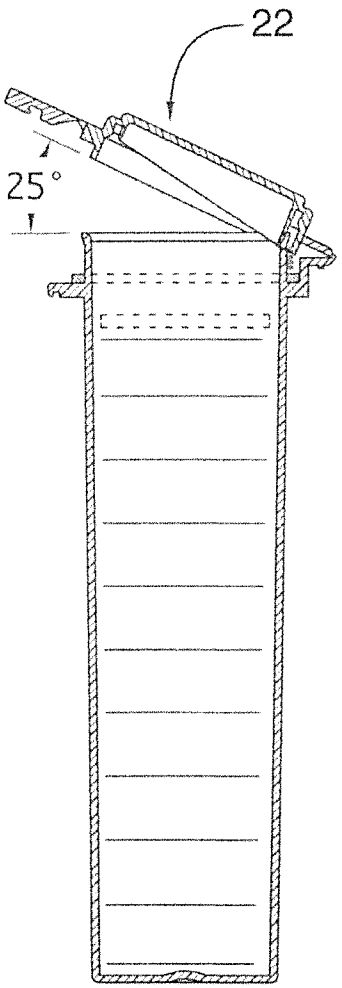
FIG. 10 is a view similar to FIG. 7, but with the cap at a 25° angle to the opening.
Figure 9:
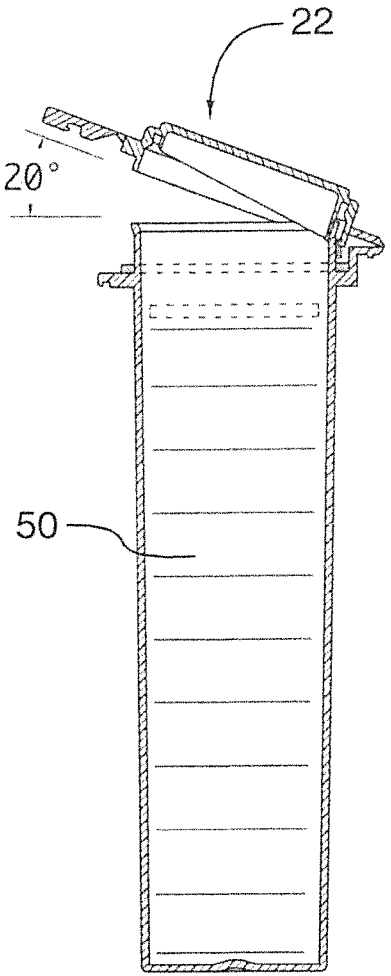
FIG. 9 is a view similar to FIG. 7, but with the cap at a 20° angle to the opening.
Figure 8:
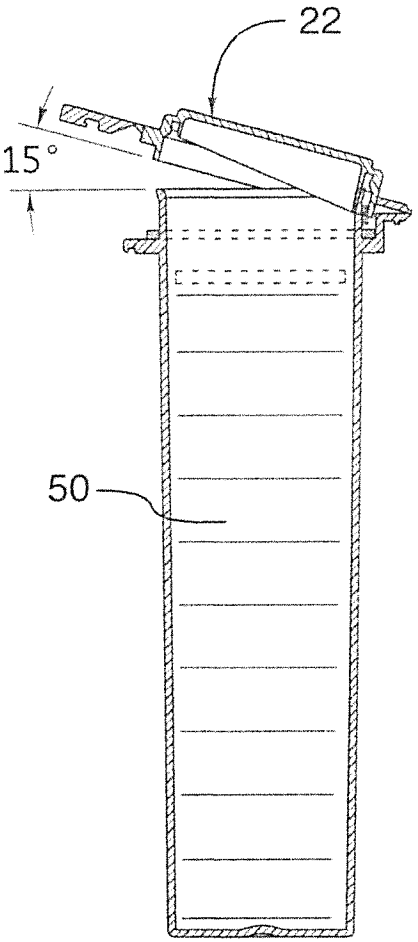
FIG. 8 is a view similar to FIG. 7, but with the cap at a 15° angle to the opening.

Returning now to the detents 36,44, these provide for snap-fit intermediate positions of the cap 22 between the position apart from the opening 56 and the fully-seated position, as shown in FIGS. 8-10.

The foregoing provides a structure of great advantage:

after molding, the container can be closed and secured shut with the locking tab 26, i.e. as shown in FIG. 6, to avoid contamination of the container the locking tab 26 can be released and the cap 22 opened; the bias provided by connector 38, which holds the cap 22 in the position shown in FIG. 7, facilitates filling of the vial 50, with a pipette or the like, particularly in the case of a rack-filling procedure, i.e. in the context of a plurality of containers arranged in an array for filling, the upright orientation of the caps means that each cap neither interferes with the filling of its own vial nor adjacent vials the detents 36,44 allow for the cap 22 to be kept open, as shown in FIGS. 8-10, for venting in a controlled manner, as is sometimes required in analysis protocols, particularly those involving heat application or gas-producing reactions the arcuate flanges 34 allow for the containers 20 to be suspended in a rack at a selected height In the context of digestion based testing protocols and the like, wherein the container is allowed to vent under controlled conditions, the sloped apex has advantage in terms of minimizing evaporative losses. By way of background, vapours will tend to condense on the underside of the cap and flow towards the apex. On reaching the apex, the slope provided therein will then tend to channel the condensate towards the connector, i.e. away from the largest portion of the opening, thereby reducing the potential for escape of vapours as the condensate drips back into the vial.

Whereas a specific structure is shown and described, persons of ordinary skill will understand that variations are possible.

For example, only, whereas in the exemplary embodiment, the position to which the cap is biased for movement [i.e. the position apart from the opening, shown by way of example in FIG. 7] is substantially vertical, i.e. 90° to the rim 54, it is contemplated that significant utility would flow at least within the range of about 90° to about 120°; throughout this range, in an array of containers, caps so orientated neither interfere significantly with the filling of own vials nor adjacent vials. Of course, it will be understood that, for example, in vial arrays wherein the vials are spaced further from one another, the position apart from the opening and to which the cap is biased could be associated with a pivot angle greater than 120° without causing interference is filling.

Further, whereas a specific plastic is mentioned, namely, homopolymer polypropylene, persons of ordinary skill in the manufacture of plastic vials could routinely substitute other plastics therefor, depending upon the intended application.

As well, whereas in the exemplary embodiment described hereinbefore and illustrated, the position apart from the opening is a position to which the cap is biased for movement, this is not strictly necessary, and significant utility would flow, for example, from apparatus wherein the cap could be manipulated to a desired position which permitted ingress to the opening without interfering with other openings in adjacent vials, and which maintained such desired position on release of the cap by the manipulator.

Accordingly, the invention should be understood as limited only by the accompanying claims, purposively construed.

The invention claimed is:

1. Apparatus comprising:

a cap having an inner surface defining a hollow;

a body including a vial having a rim and an opening bounded by the rim;

a connector coupling the cap to the body in a manner which permits movement of the cap between a fully-seated position on the vial, to form a sealed specimen container; and a position apart from the opening, to permit ingress to the vial wherein the connector is adapted such that, in use, when the cap is disposed at the position apart from the opening, and in the absence of external forces, the connector holds the cap at the position apart from the opening wherein the cap and the vial have inter-engageable detents which provide for at least one snap-fit intermediate position of the cap between the position apart from the opening and the fully-seated position the inter-engageable detents comprise: at least one detent positioned on the vial; and at least one detent positioned on the inner surface of the cap and protruding into the hollow; and the at least one detent positioned on the vial is disposed beneath the rim.

2. Apparatus according to claim 1, wherein the cap has an initial position removed from the opening.

3. Apparatus according to claim 2, wherein movement of the cap from the initial position to the fully-seated position results in inelastic deformation of the connector, said inelastic deformation of the connector adapting said connector such that, as aforesaid, in use, when the cap is disposed at the position apart from the opening, and in the absence of external forces, the connector holds the cap at the position apart from the opening.

4. Apparatus according to claim 3, wherein, during movement between the fully-seated position and the initial position, and during movement between the fully-seated position and the position apart from the opening, the cap pivots about the rim about an axis defined by the connector.

5. Apparatus according to claim 4, wherein the vial is tubular and has a central longitudinal axis; and in the position apart from the opening, the cap extends substantially longitudinally from a position adjacent the rim of the vial.

6. Apparatus according to claim 4, wherein, during movement from the fully-seated position to the position apart from the opening, the cap rotates about a pivot axis an angle that lies in the range between about 90° and about 120°.

7. Apparatus according to claim 5, wherein the position apart from the opening is intermediate the fully-seated position and the initial position; and the connector is adapted such that, in use, when the cap is removed from the rim, and in the absence of external forces, the connector urges the cap for movement to the position apart from the opening.

8. Apparatus according to claim 1, wherein the at least one detent positioned on the vial comprises a plurality of detents.

9. Apparatus according to claim 7, wherein the body has a locking hook projecting from the vial adjacent the rim; and further comprising a locking tab having a flexible portion joining the locking tab to the cap for movement of the locking tab between an unlocking position and a locking position, the locking tab and the locking hook being adapted such that, with the cap in the fully-seated position, movement of the locking tab from the unlocking position to the locking position causes the locking tab to engage the locking hook to restrain the cap against movement from the fully-seated position.

10. Apparatus according to claim 9, wherein the locking hook and the connector are disposed on opposite sides of the vial.

11. Apparatus according to claim 1, wherein the vial has a circumferential flange disposed below the rim and which abuts the cap when the cap is in the fully-seated position.

12. Apparatus according to claim 11, wherein the detents positioned on the vial are disposed between the rim and the circumferential flange.

13. Apparatus according to claim 11, further comprising: a pair of arcuate flanges disposed on opposite sides of the vial, beneath the circumferential flange.

14. Apparatus according to claim 1, further comprising an annular ridge projecting from the cap into the hollow to define an annular groove at the base of the hollow; and wherein the rim is an enlarged rim; and when the cap is in the fully-seated position, the rim is disposed in the annular groove in snap-fit relation, with the annular ridge disposed radially inwardly of the rim and the cap disposed radially outwardly of the rim.

15. Apparatus according to claim 1 wherein an annular ridge projects from the cap into the hollow to define an annular groove at the base of the hollow, the annular ridge terminating in a circular apex; and wherein, when the cap is in the fully-seated position and the vial is seated on a horizontal surface the rim is disposed in the annular groove in snap-fit relation, with the annular ridge disposed radially inwardly of the rim and the cap disposed radially outwardly of the rim, the circular apex slopes downwardly as it extends towards the connector.

* * * * *